US006799837B1

(12) United States Patent
Chen et al.

(10) Patent No.: US 6,799,837 B1
(45) Date of Patent: Oct. 5, 2004

(54) INK JET PRINTING APPARATUS WITH INK LEVEL DETECTION

(75) Inventors: Chi-Lun Chen, Hsin-Chu Hsien (TW); Sheng-Lung Tsai, Ping-Tung Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/604,262

(22) Filed: Jul. 7, 2003

(51) Int. Cl.[7] ..... B41J 2/05
(52) U.S. Cl. ..... 347/56
(58) Field of Search ..... 347/56, 64, 63, 347/65, 57–59, 62, 61, 92, 93, 123

(56) References Cited

U.S. PATENT DOCUMENTS 4,415,886 A 11/1983 Kyogoku
5,162,817 A 11/1992 Tajika
5,315,316 A 5/1994 Khormaee
5,623,290 A 4/1997 Iida
5,822,076 A 10/1998 Maruyama
5,975,665 A 11/1999 Torigoe
6,106,087 A 8/2000 Kishi
6,123,406 A 9/2000 Imai
6,575,563 B1 * 6/2003 Cornell ..... 347/64

* cited by examiner

*Primary Examiner*—Raquel Yvette Gordon
(74) *Attorney, Agent, or Firm*—Winston Hsu

(57) ABSTRACT

A printing apparatus includes a printhead and an ink volume detecting circuit. The printhead contains a plurality of first heating elements for heating ink supplied to the printhead to generate bubbles in the ink and eject the ink through corresponding nozzles. The printhead also contains a second heating element for heating the ink supplied to the printhead, a resistance value of the second heating element being less than the resistance value of each first heating element, and the low resistance value of the second heating element causing the second heating element to burn out and create an open circuit if the volume of the ink is less than a predetermined level. The ink volume detecting circuit is connected to the second heating element for determining if the volume of the ink supplied to the printhead is less than the predetermined level based on a condition of the second heating element.

18 Claims, 4 Drawing Sheets

INK JET PRINTING APPARATUS WITH INK LEVEL DETECTION

BACKGROUND OF INVENTION

1. Field of the Invention

The present invention relates to an ink jet printer, and more specifically, to an ink jet printer capable of detecting a low volume level of ink.

2. Description of the Prior Art

Conventionally, in a printing apparatus such as an ink jet printer, an inkjet printhead conducts image printing on a print medium by ejecting ink supplied from an ink cartridge filled with ink. The printhead contains a plurality of nozzles for ejecting ink onto the print medium. Each nozzle has at least one corresponding heating element for heating ink supplied to the nozzle, creating bubbles in the ink, and ejecting the ink from the nozzles. If all of the ink in the ink cartridge is consumed, image printing cannot continue. Thus it is necessary to exchange the old ink cartridge with a new one filled with ink before ink is completely consumed, and to supply ink to the ink jet printhead. However, sometimes the user of the printing apparatus will not discover that the ink volume level is low until after the printing quality has degraded. The user does not have a way to find out that the ink is about to run out in the ink cartridge.

SUMMARY OF INVENTION

It is therefore a primary objective of the claimed invention to provide an ink jet printing apparatus that is capable of determining if an ink volume level is less than a predetermined level in order to solve the above-mentioned problems.

According to the claimed invention, a printing apparatus-includes a printhead and an ink volume detecting circuit. The printhead contains a plurality of first heating elements for heating ink supplied to the printhead to generate bubbles in the ink and eject the ink through corresponding nozzles. The printhead also contains a second heating element for heating the ink supplied to the printhead, a resistance value of the second heating element being less than the resistance value of each first heating element, and the low resistance value of the second heating element causing the second heating element to burn out and create an open circuit if the volume of the ink is less than or equal to a predetermined level. The ink volume detecting circuit is electrically connected to the second heating element for determining if the volume of the ink supplied to the printhead is less than or equal to the predetermined level based on a condition of the second heating element.

It is an advantage of the claimed invention that the ink volume detecting circuit is able to determine if the second heating element is functioning properly or has burned out, for detecting that the ink volume is less than the predetermined level.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
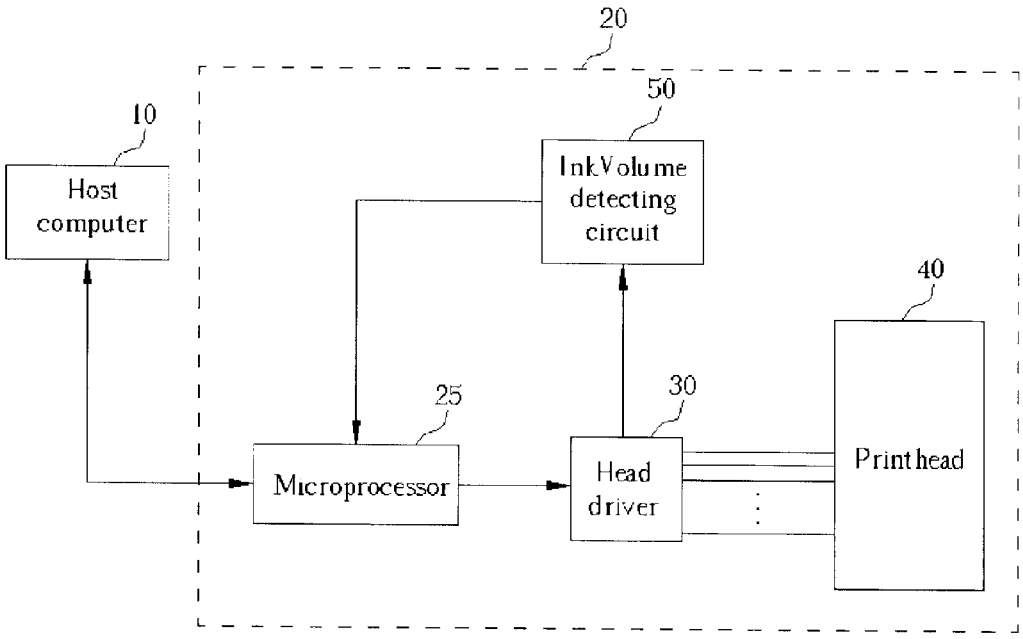
FIG. 1 is a block diagram of a host computer communicating with a printing apparatus according to the present invention.

Please refer to FIG. 1. FIG. 1 is a block diagram of a host computer 10 communicating with a printing apparatus 20 according to the present invention. The printing apparatus 20 contains a microprocessor 25 for communicating with the host computer 10 and for controlling a head driver circuit 30. The head driver circuit 30 sends a plurality of printing and non-printing signals to a printhead 40, thereby controlling the printhead 40 to eject ink onto a print medium. The printing apparatus 20 further comprises an ink volume detecting circuit 50 electrically connected to the printhead 40, the head driver circuit 30, and the microprocessor 25. As will be explained in greater detail below, the ink volume detecting circuit 50 is controlled by the head driver circuit 30 to determine if a volume level of ink supplied to the printhead 40 has fallen below a predetermined level. The ink volume detecting circuit 50 then notifies the microprocessor 25 of the status of the ink volume level.

Figure 2:
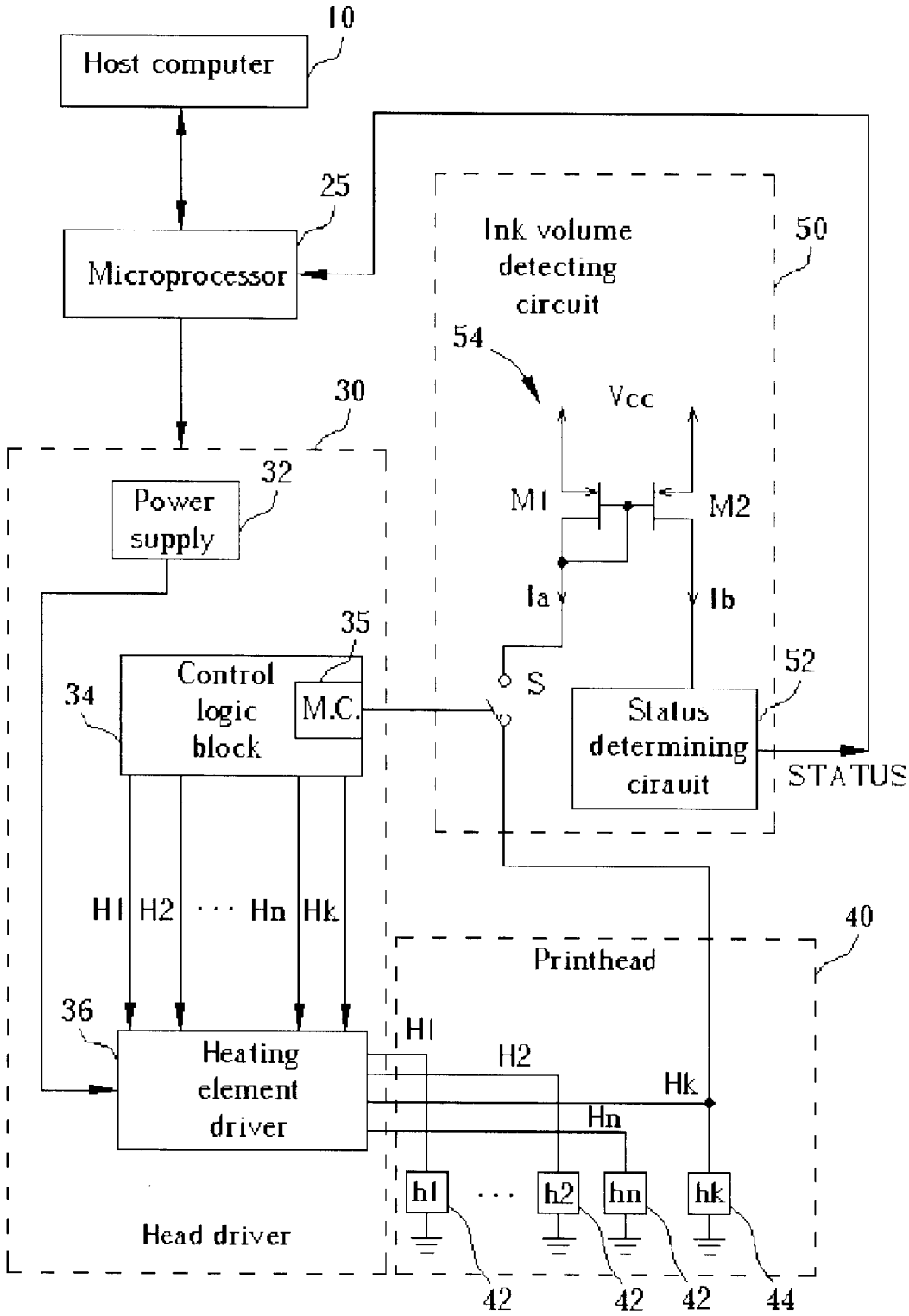
FIG. 2 is a detailed block diagram showing ink volume level detection according to the present invention.
Figure 3:
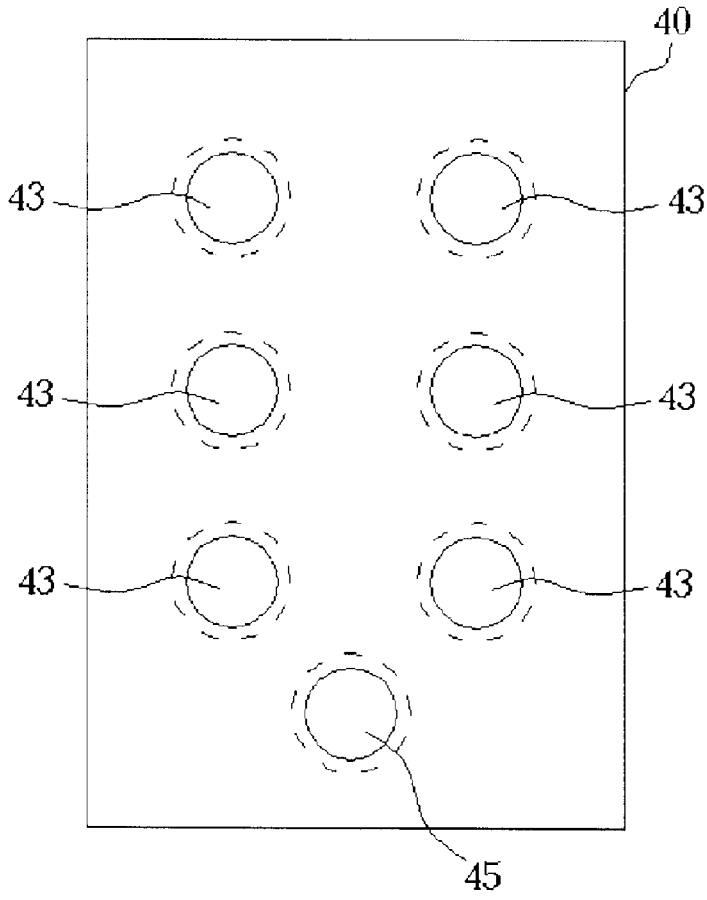
FIG. 3 shows a plurality of nozzles and a dummy nozzle formed on the printhead according to the present invention.

Please refer to FIG. 2 and FIG. 3. FIG. 2 is a detailed block diagram showing ink volume level detection according to the present invention. FIG. 3 shows a plurality of nozzles 43 and a dummy nozzle 45 formed on the printhead 40 according to the present invention. The printhead 40 comprises a plurality of first heating elements 42 corresponding to the plurality of nozzles 43. Each nozzle 43 has at least one corresponding first heating element 42 for heating ink supplied to the nozzle 43, creating bubbles in the ink, and ejecting ink from the nozzle 43. The dummy nozzle 45 formed on the printhead 40 is not used for ejecting ink, and a second heating element 44 corresponding to the dummy nozzle 45 is used testing a volume level of the ink supplied to the printhead 40.

The head driver circuit 30 comprises a heating element driver 36 for receiving control signals from a control logic block 34, and for driving the first heating elements 42 and the second heating element 44 according to the control signals. The head driver circuit 30 also includes a power supply 32 for supplying power to the heating element driver 36.

The first heating elements 42 and the second heating element 44 can all be created using resistors. A resistance value of the second heating element 44 should be lower than the resistance values of each of the first heating elements 42. When the heating element driver 36 activates the first heating elements 42 and the second heating element 44 with driving signals., the driving signals contain a voltage value V. According to Ohm's Law, a current I flowing through any one of the first heating elements 42 or the second heating element 44 will be related to its resistance R through the equation $V=I*R$. Therefore, since the second heating element 44 has a lower resistance value than that of the first heating elements 42, a larger current will flow through the second heating element 44. An amount of power P dissipated through each resistor can be calculated from the equation $P=I^2*R$. Since a larger current flows through the second heating element 44 than each first heating element 42, the second heating element 44 will dissipate a larger amount of power and will become hotter than the first heating elements 42.

Since the first heating elements 42 and the second heating element 44 are in contact with the ink supplied to the printhead 40, any heat generated by the first heating elements 42 and the second heating element 44 will be absorbed by the ink, thereby raising the temperature of the ink. When the volume level of the ink is very high, the overall temperature of the ink will only increase by a small amount due to heat from the first heating elements 42 and the second heating element 44. However, when the volume level of the ink is very low, any heat generated by the first heating elements 42 or the second heating element 44 will raise the temperature of the ink by a large amount. In addition to having the lower resistance value, the second heating element 44 is designed to have a higher sensitivity to heat than each of the first heating elements 42. Therefore, when the volume level of the ink is less than or equal to a predetermined level, the temperature of the ink will become very high and will cause the second heating element 44 to burn out. The combination of the second heating element 44 becoming hotter than the first heating elements 42 due to its small resistance and the sensitivity of the second heating element 44 to heat causes the second heating element 44 to burn out before any of the first heating elements 42 do. The printhead 40 is preferably formed on an ink cartridge of an ink jet printer. When the second heating element 44 burns out, this is an indication that the volume level of the ink cartridge is too low, and the ink cartridge should be replaced with a new one. The preferred material for the first heating elements 42 and the second heating element 44 is a tantalum-aluminum (TaAl) alloy, although poly-silicon, Titanium Nitride (TiN), or tantalum nitride (TaN) can also be used.

The ink volume detecting circuit 50 shown in FIG. 2 contains a switch S that is electrically connected between a current mirror 54 and the second heating element 44. A maintenance circuit 35 of the control logic block 34 controls the switch S to open and close in order to activate the ink volume detecting circuit 50. The maintenance circuit 35 preferably activates the ink volume detecting circuit 50 during a nozzle maintenance period of the printhead 40 to minimize the effect on printing, but the maintenance circuit 35 is also capable of activating the ink volume detecting circuit 50 at any other time.

When the switch S is closed, the current mirror 54 will be in electrical contact with the second heating element 44. If the second heating element 44 is still functioning properly (not yet burned out), then a current la having a magnitude greater than zero will flow from the current mirror 54 through the second heating element 44. On the other hand, if the second heating element 44 has already burned out, the current la will be equal to zero since the second heating element 44 acts as an open circuit when burned out. The current mirror 54 mirrors current Ia as current Ib, and a status determining circuit 52 measures the current Ib. Based on the value of current Ib, the status determining circuit 52 outputs a status signal STATUS which indicates the condition of the second heating element 44. For example, if the magnitude of current Ib is non-zero, the status signal STATUS indicates that the ink volume level is greater than the predetermined level since the second heating element 44 has not yet burned out. In contrast, if the magnitude of current Ib is equal to zero, the status signal STATUS indicates that the ink volume level is less than or equal to the predetermined level since the second heating element 44 has burned out. Instead of measuring a current flowing through the second heating element 44 the ink volume detecting circuit 50 could also measure a voltage across the second heating element 44 in order to determine the condition of the second heating element 44.

Figure 4:
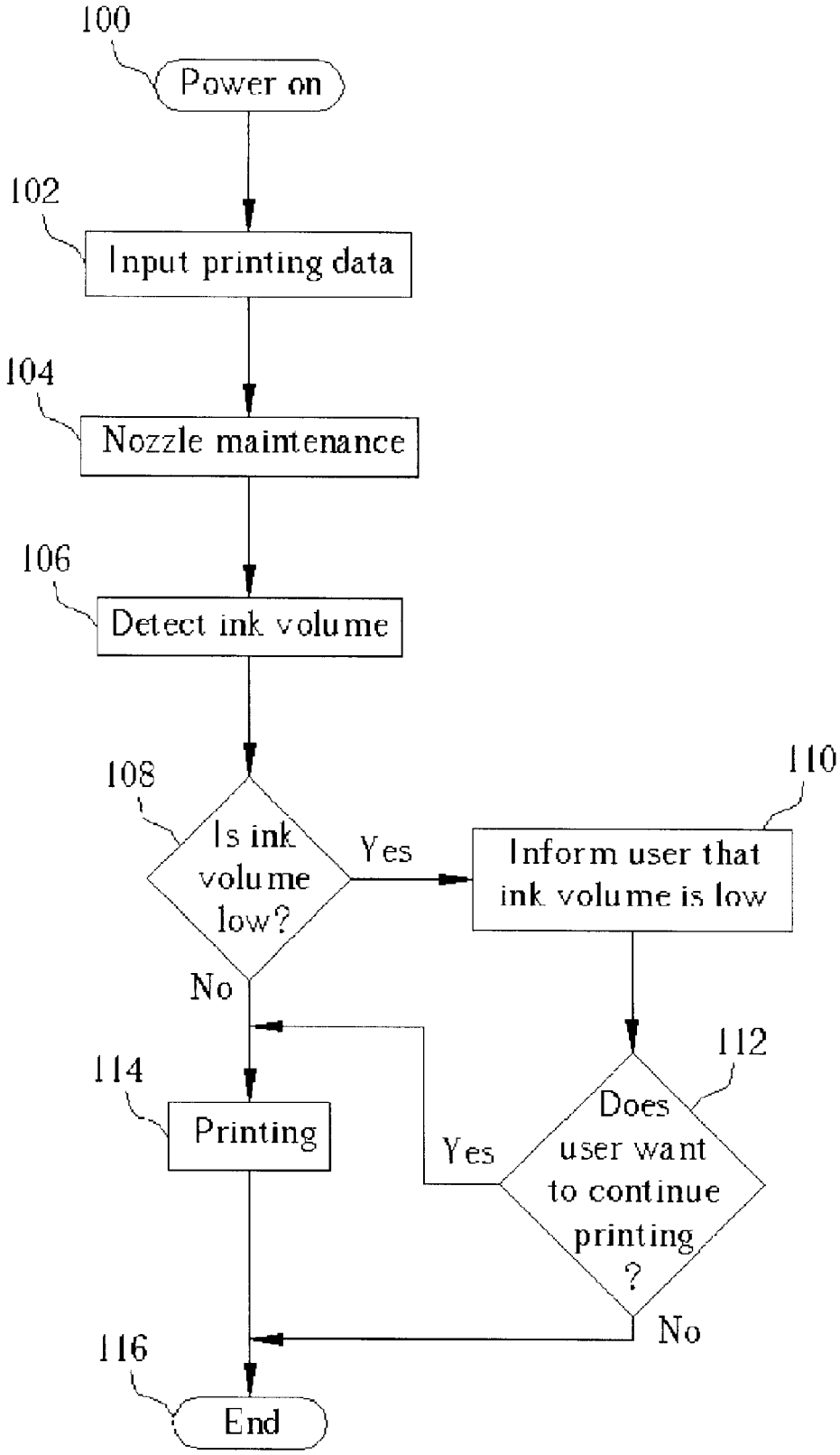
FIG. 4 is a flowchart illustrating determining the ink volume level according to the present invention method.

Please refer to FIG. 4. FIG. 4 is a flowchart illustrating determining the ink volume level according to the present invention method. Steps contained in the flowchart will be explained below.

Step 100: Power on the printing apparatus 20;

Step 102: Input printing data from the host computer 10 to the printing apparatus 20;

Step 104: During the course of printing, perform a nozzle maintenance process;

Step 106: During the nozzle maintenance process, detect the ink volume using the ink volume detecting circuit 50;

Step 108: Determine if the volume level of the ink supplied to the printhead 40 is less than or equal to the predetermined level; if so, go to step 110; if not, to go step 114;

Step 110: Since the volume level of the ink is less than or equal to the predetermined level, inform the user of the printing apparatus 20 that the ink volume level is low;

Step 112: Determine if the user wants to continue with the printing process. This gives the user a chance to either exchange the current ink cartridge with a new one or instead to terminate the printing process. If the user wishes to continue printing, go to step 114; if not, go to step 116;

Step 114: Continue the printing process; and

Step 116: End.

In summary, the present invention printing apparatus 20 contains the second heating element 44 that is capable of burning out if the volume level of the ink supplied to the printhead 40 is less than or equal to the predetermined level. When the volume level falls below the predetermined level during printing, the printing apparatus 20 will notify the user that the ink cartridge should be replaced.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A printing apparatus comprising:

a printhead comprising:

a plurality of first heating elements for heating ink supplied to the printhead to generate bubbles in the ink and eject the ink through corresponding nozzles; and a second heating element for heating the ink supplied to the printhead, a resistance value of the second heating element being less than the resistance value of each first heating element, the low resistance value of the second heating element causing the second heating element to burn out and create an open circuit if the volume of the ink is less than or equal to a predetermined level; and an ink volume detecting circuit electrically connected to the second heating element for determining if the volume of the ink supplied to the printhead is less than or equal to the predetermined level based on a condition of the second heating element.

2. The printing apparatus of claim 1 wherein the second heating element corresponds to a dummy nozzle formed on the printhead.

3. The printing apparatus of claim 1 wherein the ink volume detecting circuit comprises a current measuring circuit for measuring a current flowing through the second heating element to determine the condition of the second heating element.

4. The printing apparatus of claim 1 wherein the ink volume detecting circuit comprises a voltage measuring circuit for measuring a voltage across the second heating element to determine the condition of the second heating element.

5. The printing apparatus of claim 1 further comprising a switch electrically connected between the second heating element and the ink volume detecting circuit, the switch being controlled by a control circuit of the printing apparatus for selectively activating the ink volume detecting circuit.

6. The printing apparatus of claim 5 wherein the control circuit of the printing apparatus comprises a maintenance circuit for controlling the switch to activate the ink volume detecting circuit during a nozzle maintenance period of the printhead.

7. The printing apparatus of claim 1 wherein the first heating elements and the second heating element are composed of a tantalum-aluminum (TaAl) alloy.

8. The printing apparatus of claim 1 wherein the first heating elements and the second heating element are composed of poly-silicon, Titanium Nitride (TiN), or tantalum nitride (TaN).

9. The printing apparatus of claim 1 wherein a temperature of the ink supplied to the printhead increases as a volume of the ink decreases, and a high temperature of the ink when the volume of the ink is less than or equal to the predetermined level causes the second heating element to burn out before the first heating elements.

10. A method for heating a printhead in a printing apparatus, the printing apparatus comprising a printhead having a plurality of first heating elements for heating ink supplied to the printhead to generate bubbles in the ink and to eject the ink through corresponding nozzles; the method comprising:

heating the ink supplied to the printhead with a second heating element, a resistance value of the second heating element being less than the resistance value of each first heating element, the low resistance value of the second heating element causing the second heating element to burn out and create an open circuit if the volume of the ink is less than or equal to a predetermined level; and analyzing a condition of the second heating element to determine if the volume of the ink supplied to the printhead is less than or equal to the predetermined level.

11. The method of claim 10 wherein the second heating element corresponds to a dummy nozzle formed on the printhead.

12. The method of claim 10 wherein analyzing the condition of the second heating element comprises measuring a current flowing through the second heating element to determine the condition of the second heating element.

13. The method of claim 10 wherein analyzing the condition of the second heating element comprises measuring a voltage across the second heating element to determine the condition of the second heating element.

14. The method of claim 10 further comprising controlling a switch to analyze the condition of the second heating element at a predetermined time.

15. The method of claim 14 further comprising controlling the switch to analyze the condition of the second heating element during a nozzle maintenance period of the printhead.

16. The method of claim 10 wherein the first heating elements and the second heating element are composed of a tantalum-aluminum (TaAl) alloy.

17. The method of claim 10 wherein the first heating elements and the second heating element are composed of poly-silicon, Titanium Nitride (TiN), or tantalum nitride (TaN).

18. The method of claim 10 wherein a temperature of the ink supplied to the printhead increases as a volume of the ink decreases, and a high temperature of the ink when the volume of the ink is less than or equal to the predetermined level causes the second heating element to burn out before the first heating elements.

* * * * *